US007331879B2

(12) United States Patent
Sajima

(10) Patent No.: US 7,331,879 B2
(45) Date of Patent: Feb. 19, 2008

(54) GOLF BALL

(75) Inventor: Takahiro Sajima, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

(21) Appl. No.: 11/603,136

(22) Filed: Nov. 22, 2006

(65) Prior Publication Data

US 2007/0149321 A1 Jun. 28, 2007

(30) Foreign Application Priority Data

Dec. 28, 2005 (JP) ..... 2005-376942

(51) Int. Cl.
*A63B 37/12* (2006.01)

(52) U.S. Cl. ..... 473/378

(58) Field of Classification Search ..... 473/378–385
See application file for complete search history.

(56) References Cited

U.S. PATENT DOCUMENTS 6,849,007 B2 * 2/2005 Morgan et al. ..... 473/378
2004/0157682 A1 8/2004 Morgan et al.
2004/0254033 A1 * 12/2004 Ogg ..... 473/378

FOREIGN PATENT DOCUMENTS

JP 04-109968 A 4/1992

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a northern hemisphere N above the equatorial line 16, and a southern hemisphere S below the equatorial line 16. Each of the northern hemisphere N and the southern hemisphere S has a pole vicinity region 18, an equator vicinity region 20 and a coordination region 22. The pole vicinity region 18, the equator vicinity region 20 and the coordination region 22 have numerous dimples 8, respectively. The dimple pattern in the pole vicinity region 18 includes multiple units that are rotationally symmetric each other centered on the pole point P. The dimple pattern in the equator vicinity region 20 includes multiple units that are rotationally symmetric each other centered on the pole point P. Number of the units in the pole vicinity region 18 is different from number of the units in the equator vicinity region 20. The dimple pattern in the coordination region 22 cannot be comparted into multiple units that are rotationally symmetric each other centered on the pole point P.

9 Claims, 10 Drawing Sheets

GOLF BALL

This application claims priority on Patent Application No. 2005-376942 filed in JAPAN on Dec. 28, 2005. The entire contents of this Japanese Patent Application are hereby incorporated by reference.

BACKGROUND OF THE INVENTION

1. Field of the Invention:

The present invention relates to golf balls. More particularly, the present invention relates to the improvement of dimples of golf balls.

2. Description of the Related Art:

Golf balls have numerous dimples on the surface thereof. The dimples disrupt the air flow around the golf ball during flight to cause turbulent flow separation. By causing the turbulent flow separation, separating points of the air from the golf ball shift backwards leading to the reduction of drag. The turbulent flow separation prolongs the gap between the separating point on the upper side and the separating point on the lower side of the golf ball, which results from the backspin, thereby enhancing the lift force that acts upon the golf ball. The reduction in drag and the elevation of the lift force are referred to as the "dimple effect". Excellent dimples disturb the air flow more efficiently. Owing to the excellent dimples, great flight distance can be achieved.

In addition to the flight distance, aerodynamic symmetry is also important for the golf balls. Flight distance of the golf balls that are excellent in the aerodynamic symmetry is not dependent on the impact point. Golf players can easily let the golf ball drop to a target position. Aerodynamic symmetry is important also in view of conformity to the rules defined by the United States Golf Association.

In light of the flight distance and aerodynamic symmetry, various proposals on dimple pattern have been made. JP-A No. H4-109968 discloses a dimple pattern formed on the hemisphere comparted into 6 units. US 2004/157682 (JP-A No. 2004-243124) discloses a dimple pattern in which an octahedron is used for compartments in the pole vicinity region, and an icosahedron is used for compartments in the equator vicinity region.

A top concern to golf players for golf balls is the flight distance of the golf balls. In light of the flight performance, there is room for improvement of the dimple pattern. An object of the present invention it to provide a golf ball that is excellent in flight performance.

SUMMARY OF THE INVENTION

The surface of the golf ball according to the present invention can be comparted into a northern hemisphere and a southern hemisphere. The northern hemisphere and the southern hemisphere have a pole vicinity region, an equator vicinity region and a coordination region, respectively. This coordination region is located between the pole vicinity region and the equator vicinity region. Each of the pole vicinity region, the equator vicinity region and the coordination region has numerous dimples. The dimple pattern in the pole vicinity region includes multiple units. These units are rotationally symmetric to each other centered on the pole point. The dimple pattern in the equator vicinity region includes multiple units. These units are rotationally symmetric to each other centered on the pole point. The number of the units in the pole vicinity region is different from the number of the units in the equator vicinity region. The dimple pattern in the coordination region is either a pattern which cannot be comparted into multiple units that are rotationally symmetric to each other centered on the pole point, or a pattern including multiple units that are rotationally symmetric to each other centered on the pole point with the number of the units being different from the numbers of the units of the pole vicinity region and the equator vicinity region.

In this golf ball, resulting from the number of the units in the pole vicinity region being different from the number of the units in the equator vicinity region, a great dimple effect can be achieved. This golf ball is excellent in flight performance.

Preferably, a boundary line between the pole vicinity region and the coordination region is a latitude line the latitude of which is 20° or greater and 40° or less, and a boundary line between the coordination region and the equator vicinity region is a latitude line the latitude of which is 20° or greater and 40° or less.

Preferably, the number of the units in the pole vicinity region is equal to or greater than 4, and the number of the units in the equator vicinity region is equal to or greater than 4. Preferably, the number of the units in the pole vicinity region is equal to or greater than 5, and the number of the units in the equator vicinity region is equal to or greater than 5.

Preferably, total number of the dimples is equal to or less than 360, and a proportion of a total area of all dimples to a surface area of the phantom sphere is equal to or greater than 75%.

Preferably, the number of the units in the pole vicinity region is an odd number, and the number of the units in the equator vicinity region is an even number. To the contrary, it is acceptable that the number of the units in the pole vicinity region is an even number, and the number of the units in the equator vicinity region is an odd number. Preferably, the difference between the number of the units in the pole vicinity region and the number of the units in the equator vicinity region is 1.

DESCRIPTION OF THE PREFERRED EMBODIMENTS

Hereinafter, the present invention will be described in detail according to the preferred embodiments of the present invention with appropriate references to the accompanying drawing.

Figure 1:
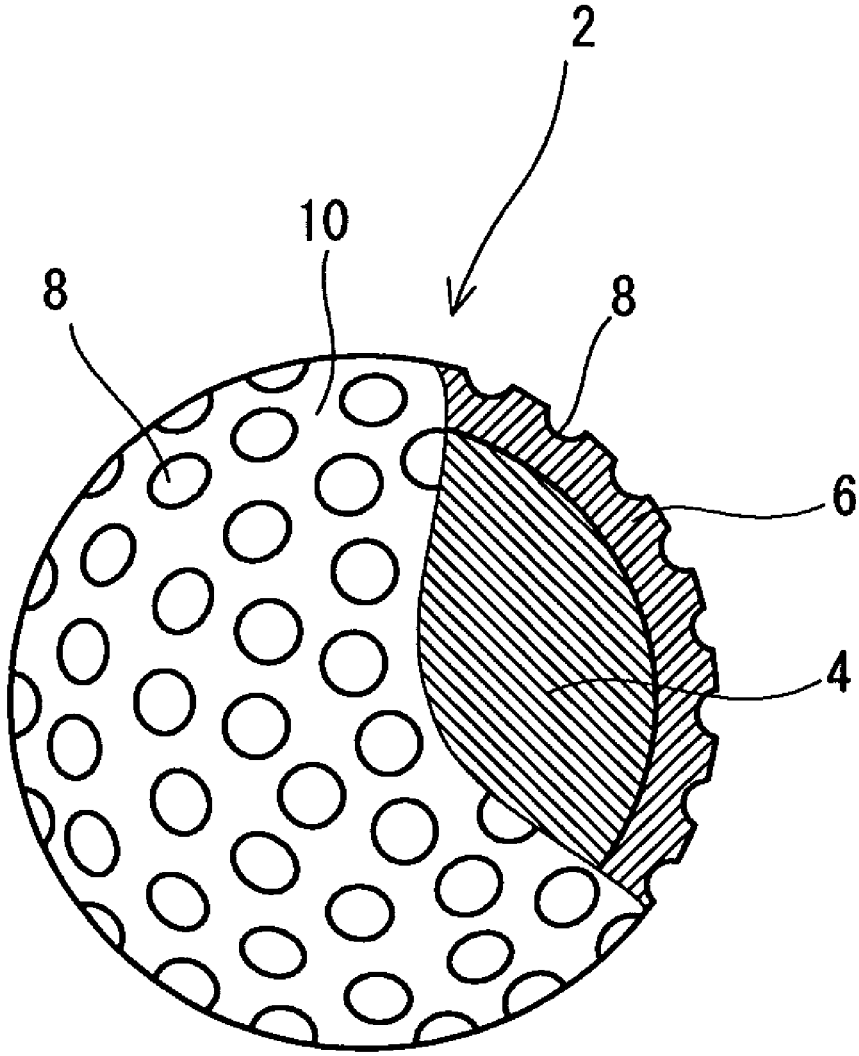
FIG. 1 shows a schematic cross-sectional view illustrating a golf ball according to one embodiment of the present invention.

A golf ball shown in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure. A mid layer may be provided between the core 4 and the cover 6.

This golf ball 2 has a diameter of 40 mm or greater and 45 mm or less. From the standpoint of conformity to a rule defined by United States Golf Association (USGA), the diameter is more preferably equal to or greater than 42.67 mm. In light of a suppression of the air resistance, the diameter is more preferably equal to or less than 44 mm, and particularly preferably equal to or less than 42.80 mm. The weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is more preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is suitable used. Examples of the co-crosslinking agent that is preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended in an adequate amount into the rubber composition of the core 4 as needed. Into the rubber composition may be also blended crosslinked rubber powder or synthetic resin powder.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core may be composed of two or more layers.

A polymer which may be suitably used in the cover 6 is an ionomer resin. Examples of preferred ionomer resin include binary copolymers formed with α-olefin and an α,β-unsaturated carboxylic acid having 3 or more and 8 or less carbon atoms. Examples of other preferred ionomer resin include ternary copolymers formed with α-olefin, an α,β-unsaturated carboxylic acid having 3 or more and 8 or less carbon atoms, and an α,β-unsaturated carboxylate ester having 2 or more and 22 or less carbon atoms. In the binary copolymer and ternary copolymer, preferable α-olefin is ethylene and propylene, and preferable α,β-unsaturated carboxylic acid is acrylic acid and methacrylic acid. In the binary copolymer and ternary copolymer, a part of the carboxyl group is neutralized with a metal ion. Illustrative examples of the metal ion for use in neutralization include sodium ion, potassium ion, lithium ion, zinc ion, calcium ion, magnesium ion, aluminum ion and neodymium ion.

Other polymers may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.3 mm, and particularly equal to or greater than 0.5 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover may be composed of two or more layers.

Figure 2:
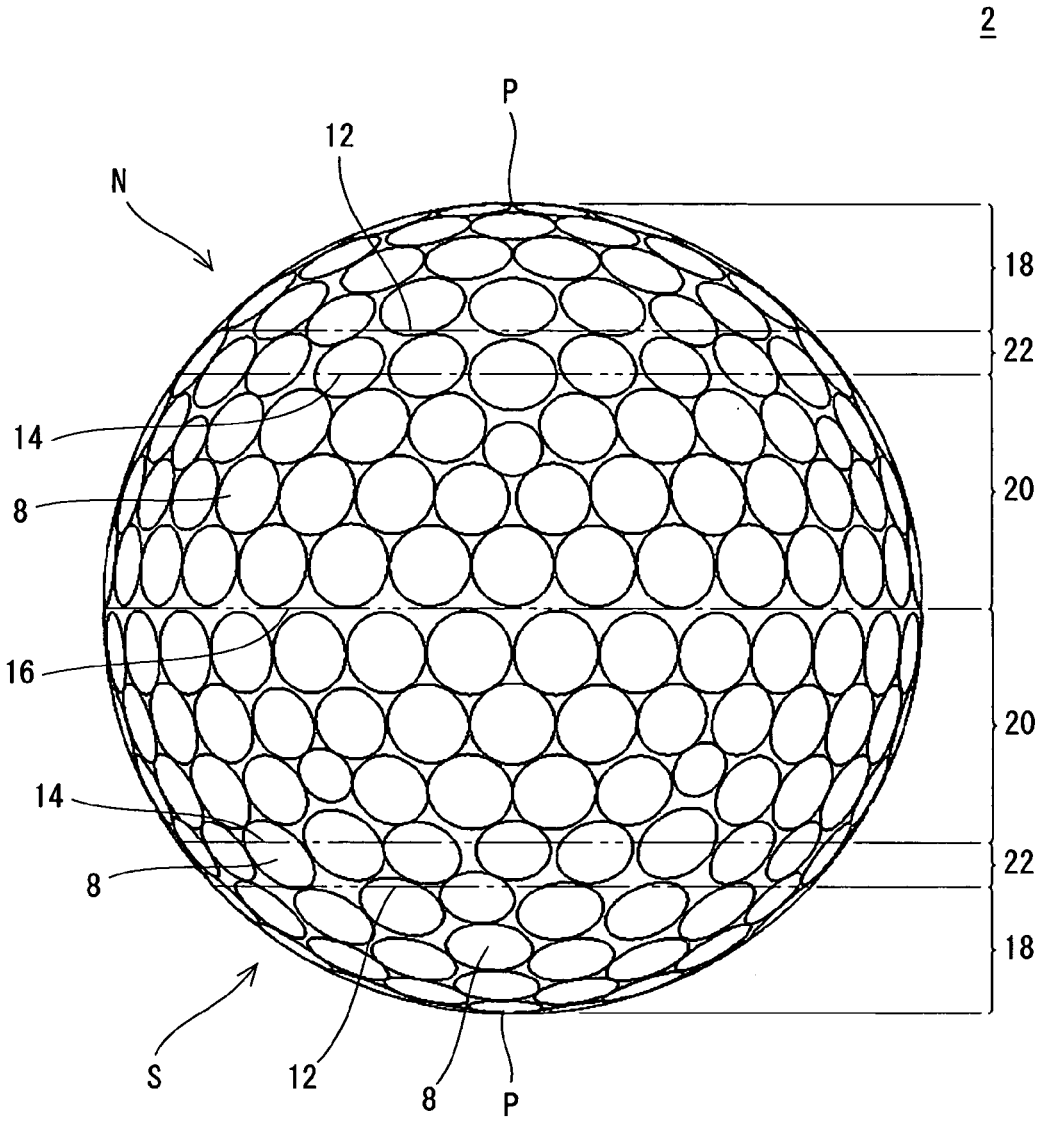
FIG. 2 shows an enlarged front view illustrating the golf ball shown in FIG. 1.

FIG. 2 shows an enlarged front view illustrating the golf ball 2 shown in FIG. 1. In FIG. 2, two pole points P, two first latitude lines 12, two second latitude lines 14 and an equatorial line 16 are depicted. Latitude of the pole point P is 90°, and latitude of the equatorial line 16 is 0°. The latitude of the first latitude line 12 is greater than that of the second latitude line 14.

This golf ball 2 has a northern hemisphere N above the equatorial line 16, and a southern hemisphere S below the equatorial line 16. Each of the northern hemisphere N and the southern hemisphere S has a pole vicinity region 18, an equator vicinity region 20 and a coordination region 22. The first latitude line 12 is a boundary line between the pole vicinity region 18 and the coordination region 22. The second latitude line 14 is a boundary line between the equator vicinity region 20 and the coordination region 22. The pole vicinity region 18 is located between the pole point P and the first latitude line 12. The equator vicinity region 20 is located between the second latitude line 14 and the equatorial line 16. The coordination region 22 is located between the first latitude line 12 and the second latitude line 14. In other words, the coordination region 22 is located between the pole vicinity region 18 and the equator vicinity region 20.

The pole vicinity region 18, the equator vicinity region 20 and the coordination region 22 have numerous dimples 8, respectively. As is clear from FIG. 2, all dimples 8 have a circular plane shape. With respect to the dimple 8 crossing over the first latitude line 12 or the second latitude line 14, the region to which it belongs is decided on the basis of the center position of this dimple 8. The dimple 8 which crosses over the first latitude line 12 and which has the center positioned in the pole vicinity region 18 belongs to the pole vicinity region 18. The dimple 8 which crosses over the first latitude line 12 and which has the center positioned in the coordination region 22 belongs to the coordination region 22. The dimple 8 which crosses over the second latitude line 14 and which has the center positioned in the equator vicinity region 20 belongs to the equator vicinity region 20. The dimple 8 which crosses over the second latitude line 14 and which has the center positioned in the coordination region 22 belongs to the coordination region 22. The center of the dimple 8 means a point where a straight line drawn between the deepest point of the dimple 8 and the center of the golf ball 2 crosses the phantom sphere. The phantom sphere is the surface of the golf ball 2 when it is postulated that there exists no dimple 8.

Figure 3:
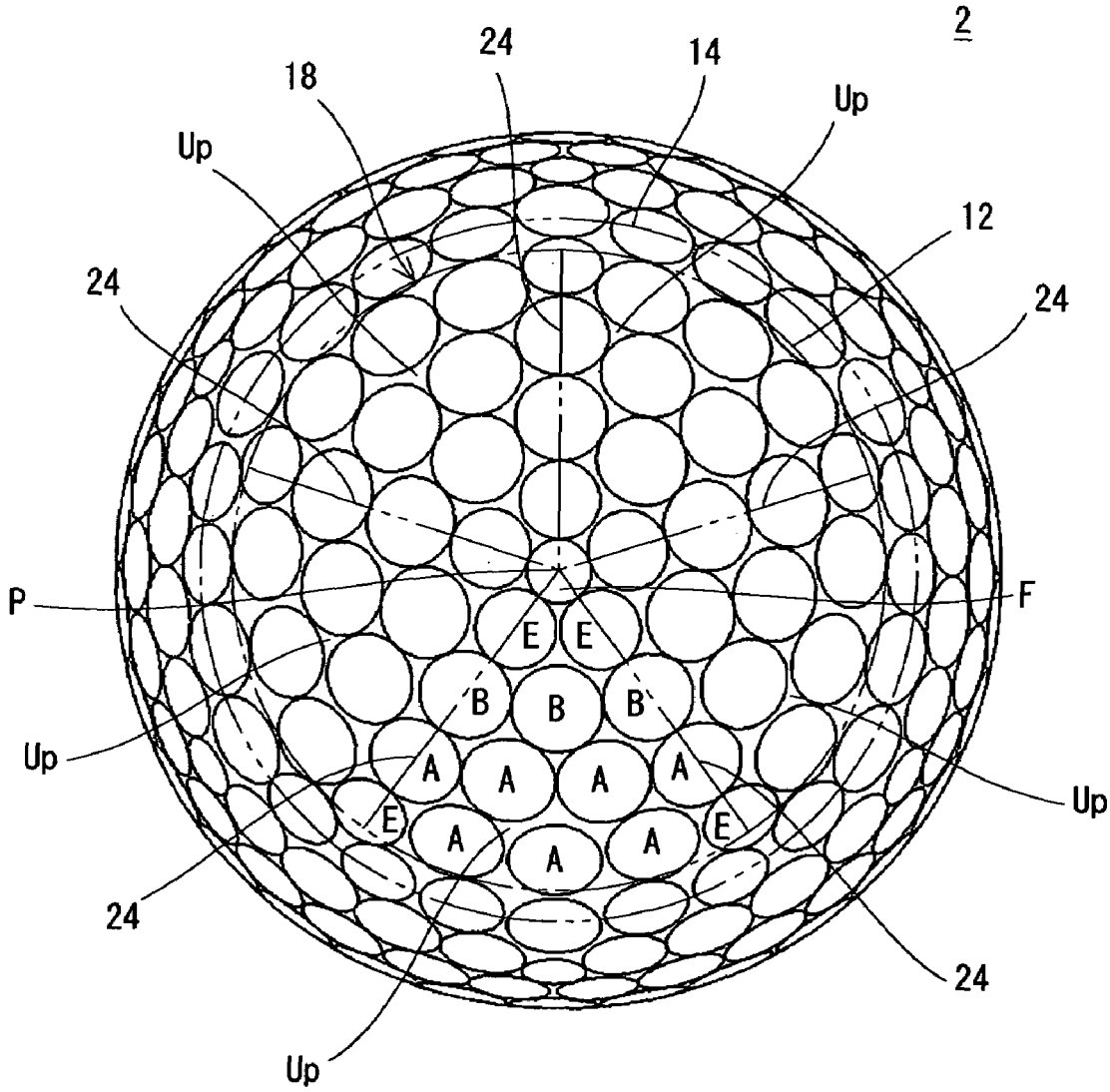
FIG. 3 shows a plan view illustrating the golf ball shown in FIG. 2.
Figure 4:
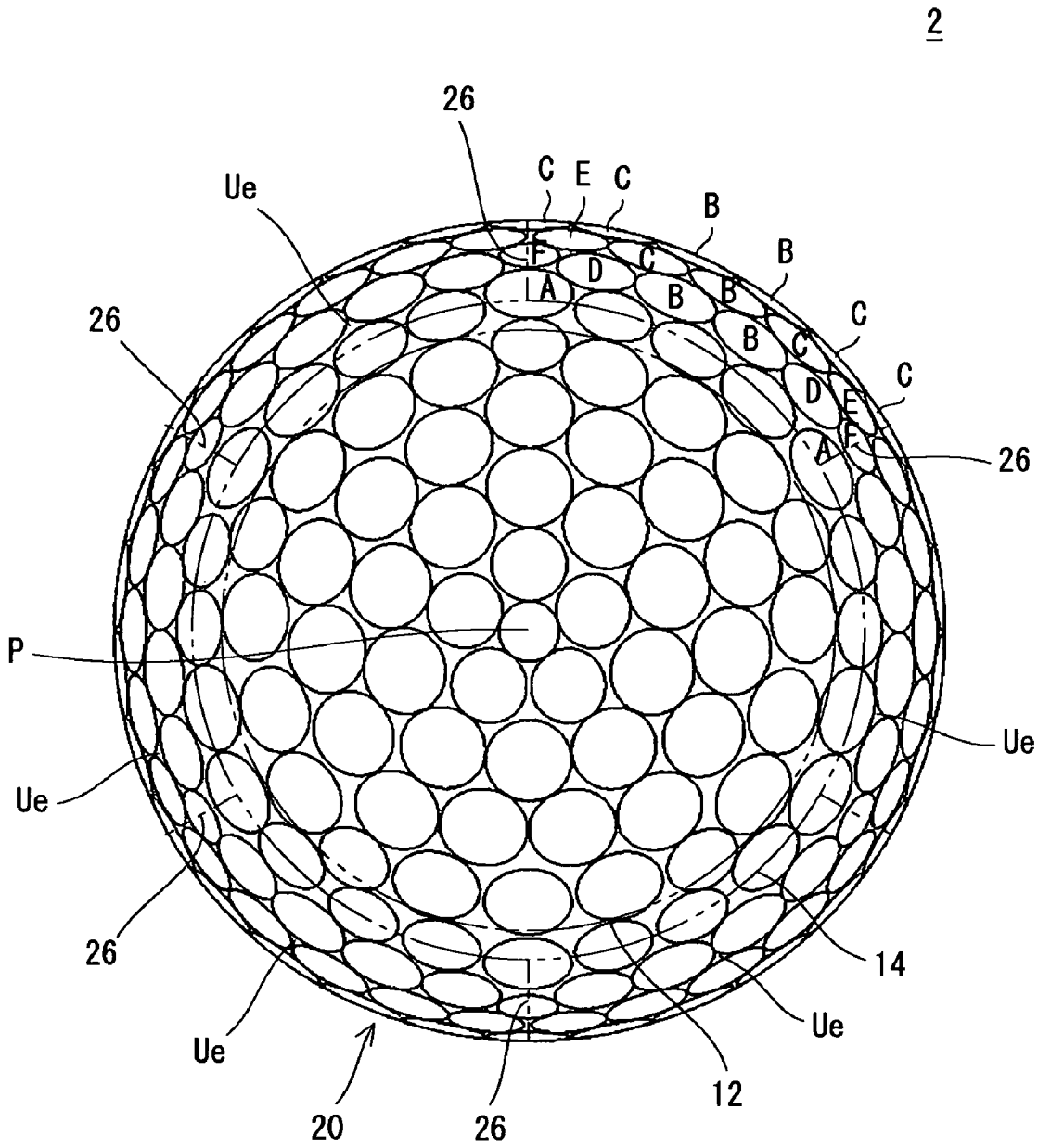
FIG. 4 shows a plan view illustrating the golf ball shown in FIG. 2.
Figure 5:
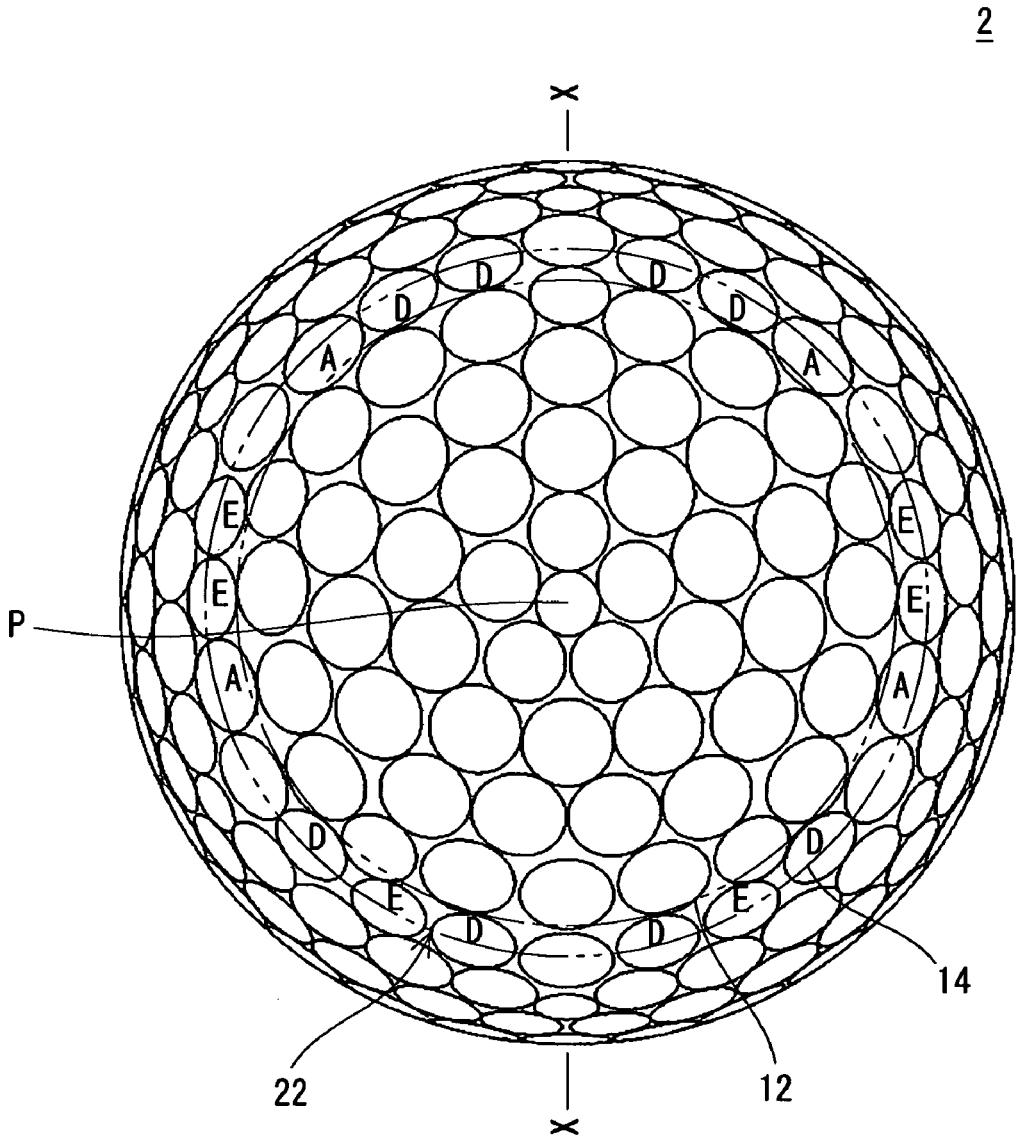
FIG. 5 shows a plan view illustrating the golf ball shown in FIG. 2.

FIGS. 3, 4 and 5 show a plan view illustrating the golf ball 2 shown in FIG. 2. FIG. 3 shows five first meridian lines 24 together with the first latitude line 12 and the second latitude line 14. In this FIG. 3, the region surrounded by the first latitude line 12 is the pole vicinity region 18. The pole vicinity region 18 can be comparted into five units Up. The unit Up has a spherical triangular shape. The contour of the unit Up consists of the first latitude line 12, and two first meridian lines 24. In FIG. 3, the types of the dimples 8 are shown by the reference signs A, B, E and F with respect to one unit Up. The pole vicinity region 18 has dimples A having a diameter of 4.55 mm, dimples B having a diameter of 4.45 mm, dimples E having a diameter of 3.85 m, and a dimple F having a diameter of 3.00 mm.

The dimple pattern in five units Up has rotational symmetries through 72°. In other words, when the dimple pattern in one unit Up is rotated 72° in a meridian direction around the pole point P as a center, it substantially overlaps with the dimple pattern in the adjacent unit Up. Herein, the states of "substantially overlapping" include not only the states in which the dimple 8 in one unit completely coincides with the corresponding dimple 8 in another unit, but also the states in which the dimple 8 in one unit is shifted to some extent from the corresponding dimple 8 in another unit. Herein, the states of "shifting to some extent" include the states in which the center of the dimple 8 in one unit deviates to some extent from the center of the corresponding dimple 8 in another unit. The distance between the dimple 8 in one unit and the corresponding dimple 8 in another unit is preferably equal to or less than 1.0 mm, and more preferably equal to or less than 0.5 mm. Herein, the states of "shifting to some extent" include the states in which the dimension of the dimple 8 in one unit is different to some extent from the dimension of the corresponding dimple 8 in another unit. The difference in dimension is preferably equal to or less than 0.5 mm, and more preferably equal to or less than 0.3 mm. The dimension means the length of the longest line segment which can be depicted over the contour of the dimple 8. In the case of a circular dimple 8, the dimension is identical with the diameter of the same.

FIG. 4 shows six second meridian lines 26 together with the first latitude line 12 and the second latitude line 14. FIG. 4, the external side of the second latitude line 14 corresponds to the equator vicinity region 20. The equator vicinity region 20 can be comparted into six units Ue. The unit Ue has a spherical trapezoidal shape. The contour of the unit Ue consists of the second latitude line 14, two second meridian lines 26 and the equatorial line 16 (see, FIG. 2). In FIG. 4, the types of the dimples 8 are shown by the reference signs from A to F with respect to one unit Ue. The pole vicinity region 18 has the dimples A having a diameter of 4.55 mm, the dimples B having a diameter of 4.45 mm, dimples C having a diameter of 4.25 mm, dimples D having a diameter of 4.10 mm, the dimples E having a diameter of 3.85 m, and the dimples F having a diameter of 3.00 mm.

The dimple pattern in six units Ue has rotational symmetries through 60°. In other words, when the dimple pattern in one unit Ue is rotated 60° in a meridian direction around the pole point P as a center, it substantially overlaps with the dimple pattern in the adjacent unit Ue. The dimple pattern in the equator vicinity region 20 can be also comparted into three units. In this instance, the dimple pattern in each unit has rotational symmetries through 120°. The dimple pattern in the equator vicinity region 20 can be also comparted into two units. In this instance, the dimple pattern in each unit has rotational symmetries through 180°. The dimple pattern in the equator vicinity region 20 has three rotation symmetry angles (i.e., 60°, 120° and 180°). In the region having multiple rotation symmetry angles, the unit Ue is defined by the compartment on the basis of the smallest rotation symmetry angle (in this case, 60°).

FIG. 5 shows the first latitude line 12 and the second latitude line 14. In FIG. 5, the region surrounded by the first latitude line 12 and the second latitude line 14 is the coordination region 22. In FIG. 5, with respect to the dimples 8 in the coordination region 22, the types thereof are shown by the reference signs A, D and E. The coordination region 22 has the dimples A having a diameter of 4.55 mm, the dimples D having a diameter of 4.10 mm, and the dimples E having a diameter of 3.85 m.

The dimple pattern in the coordination region 22 has a line symmetry with respect to line X-X in a plan view. This dimple pattern does not have any axis of symmetry other than the line X-X. A rotation of 0° or greater and less than 360° around the pole point P as a center does not generate overlap of the dimple patterns with one another. In other words, the dimple pattern in the coordination region 22 cannot be comparted into multiple units that are rotationally symmetric to each other.

The dimples pattern in the coordination region 22 which can be comparted into multiple units that are rotationally symmetric is also acceptable. In this instance, the number of the units in the coordination region 22 must be different from the number of the units Up in the pole vicinity region 18, and further, must be also different from the number of the units Ue in the equator vicinity region 20.

In this golf ball 2, number Np of the units Up in the pole vicinity region 18 is 5, while number Ne of the units Ue in the equator vicinity region 20 is 6. These numbers are different from each other. The dimple pattern with the number Np and the number Ne being different from each other is varied. According to this golf ball 2, air flow during the flight is efficiently disturbed. This golf ball 2 is excellent in flight performance. The combinations of the number Np and the number Ne (Np, Ne) is not limited to (5, 6) as described above. Illustrative examples of other combination include (2, 3), (2, 4), (2, 5), (2, 6), (3, 2), (3, 4), (3, 5), (3, 6), (4, 2), (4, 3), (4, 5), (4, 6), (5, 2), (5, 3), (5, 4), (6, 2), (6, 3), (6, 4) and (6, 5).

Although detailed grounds are unknown, a greater dimple effect can be achieved when one of the number Np and the number Ne is an odd number, and another is an even number, according to findings attained by the present inventor. In addition, a particularly great effect can be achieved when the difference between the number Np and the number Ne is 1. Illustrative examples of the combinations involving this difference of 1 include (2, 3), (3, 2), (3, 4), (4, 3), (4, 5), (5, 4), (5, 6) and (6, 5).

In light of the dimple effect, it is preferred that the pole vicinity region 18 has a sufficient area, and that the equator vicinity region 20 has a sufficient area. In light of the area of the equator vicinity region 20, the latitude of the first latitude line 12 and the second latitude line 14 is preferably equal to or greater than 20°, and more preferably equal to or greater than 25°. In light of the area of the pole vicinity region 18, the latitude of the first latitude line 12 and the second latitude line 14 is preferably equal to or less than 40°, and more preferably equal to or less than 35°. The first latitude line 12 can be arbitrarily selected from among innumerable latitude lines. The second latitude line 14 can be also selected arbitrarily from among innumerable latitude lines.

In light of the contribution of the pole vicinity region 18 to the dimple effect, the proportion of the number of the dimples 8 that exist in the pole vicinity region 18 to total number of the dimples 8 is preferably equal to or greater than 20%, and more preferably equal to or greater than 25%. This proportion is preferably equal to or less than 40%.

In light of the contribution of the equator vicinity region 20 to the dimple effect, proportion of the number of the dimples 8 that exist in the equator vicinity region 20 to the total number of the dimples 8 is preferably equal to or greater than 40%, and more preferably equal to or greater than 45%. This proportion is preferably equal to or less than 65%.

Provided that the pole vicinity region 18 is adjacent to the equator vicinity region 20 across the boundary line, the dimples 8 cannot be arranged densely in the vicinity of this boundary line resulting from the difference in the numbers of the units. In this case, large land 10 shall be present in the vicinity of the boundary line. The large land 10 inhibits the dimple effect. In the golf ball 2 according to the present invention, the coordination region 22 is present between the pole vicinity region 18 and the equator vicinity region 20. In this coordination region 22, the dimples 8 can be arranged without being bound by the number of the units. Thus, the area of the land 10 can be diminished. Owing to this coordination region 22, a high occupation ratio (described later in detail) may be achieved.

In light of the occupation ratio, it is preferred that the coordination region 22 has a sufficient area. In this respect, the difference between the latitude of the first latitude line 12 and the latitude of the second latitude line 14 is preferably equal to or greater than 5°. When the coordination region 22 is too large, the dimple effect resulting from the difference between the number Np and the number Ne may be deteriorated. In light of the dimple effect, the difference between the latitude of the first latitude line 12 and the latitude of the second latitude line 14 is preferably equal to or less than 15°, and more preferably equal to or less than 10°.

In light of the occupation ratio, the proportion of the number of the dimples 8 that exist in the coordination region 22 to the total number of the dimples 8 is preferably equal to or greater than 5%, and more preferably equal to or greater than 8%. In light of the dimple effect resulting from the difference between the number Np and the number Ne, this proportion is preferably equal to or less than 20%, more preferably equal to or less than 18%, and particularly preferably equal to or less than 16%.

According to the golf ball 2 in which the pole vicinity region 18 is comparted into the units Up, and further the equator vicinity region 20 is comparted into the units Ue, a period of the pattern is generated by rotation. As the number Np of the units Up and the number Ne of the units Ue are larger, the period becomes shorter. To the contrary, as the number Np and the number Ne are smaller, the period becomes longer. An adequate period may improve the dimple effect. In light of the adequate period, the number Np and the number Ne are preferably 4 or greater and 6 or less, and particularly preferably 5 or greater and 6 or less. Most preferable combination of the number Np and the number Ne (NP, Ne) is (5, 6) and (6, 5). In the golf ball 2 shown in FIG. 2 to FIG. 5, (Np, Ne) is (5, 6).

In light of the aerodynamic symmetry, it is preferred that the dimple pattern in the northern hemisphere N be equivalent to the dimple pattern in the southern hemisphere S. When a pattern that is symmetric to the dimple pattern in the northern hemisphere N with respect to the plane that includes the equatorial line 16 substantially overlaps with the dimple pattern in the southern hemisphere S, these patterns are decided to be equivalent. Also, when the pattern that is symmetric to the dimple pattern in the northern hemisphere N with respect to the plane that includes the equatorial line 16, upon rotation thereof around the pole point P as a center, substantially overlaps with the dimple pattern in the southern hemisphere S, these patterns are decided to be equivalent.

In light of possible achievement of sufficient dimple effect, total number of the dimples 8 is preferably equal to or greater than 200, and particularly preferably equal to or greater than 260. In light of the possibility that respective dimples 8 can have a sufficient diameter, the total number is preferably equal to or less than 500, more preferably equal to or less than 360, and particularly preferably equal to or less than 350.

Figure 6:
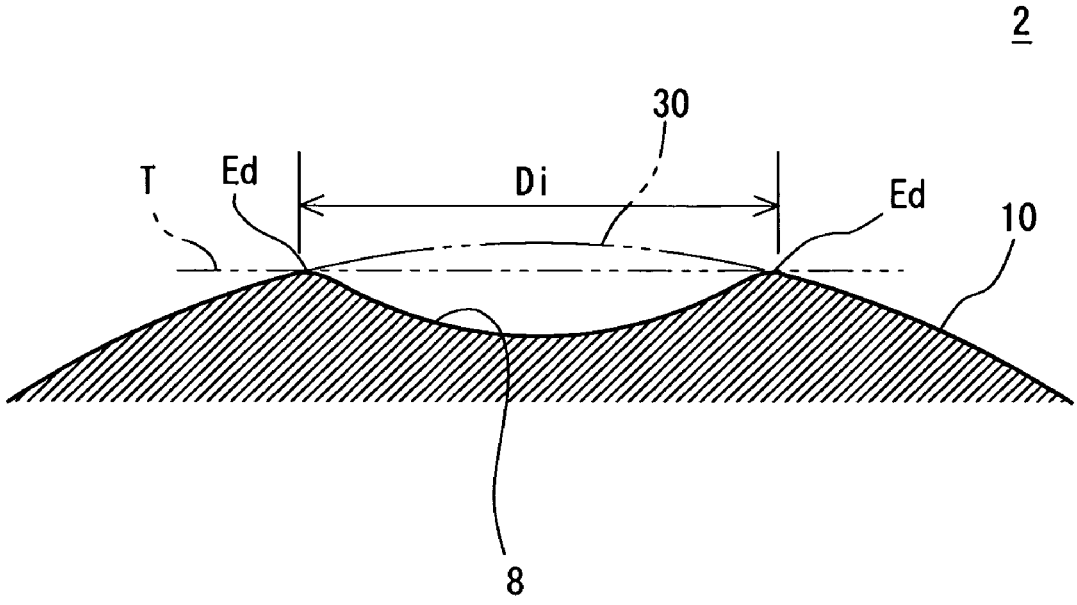
FIG. 6 shows an enlarged cross-sectional view illustrating a part of the golf ball shown in FIG. 1.

FIG. 6 shows an enlarged cross-sectional view illustrating a part of the golf ball 2 shown in FIG. 1. In FIG. 6, a cross section along a plane passing through the deepest part of the dimple 8 and the center of the golf ball 2 is shown. A top-to-bottom direction in FIG. 6 is an in-depth direction of the dimple 8. What is indicated by a chain double-dashed line 30 in FIG. 6 is a phantom sphere. The dimple 8 is recessed from the phantom sphere 30. The land 10 agrees with the phantom sphere 30.

In FIG. 6, what is indicated by a both-oriented arrowhead Di is the diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 2.00 mm or greater and 6.00 mm or less. By setting the diameter Di to be equal to or greater than 2.00 mm, a great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, a fundamental feature of the golf ball 2 which is substantially a sphere can be maintained. In this respect, the diameter Di is more preferably equal to or less than 5.8 mm, and particularly preferably equal to or less than 5.60 mm.

The area s of the dimple 8 is an area of a region surrounded by the contour line when the center of the golf ball 2 is viewed at infinity. In instances of a circular dimple 8, the area s is calculated by the following formula:

$$s=(Di/2)^2\cdot\pi.$$

In the golf ball 2 shown in FIG. 1 to FIG. 6, the area of the dimple A is 16.26 $mm^2$; the area of the dimple B is 15.55 $mm^2$; the area of the dimple C is 14.19 $mm^2$; the area of the dimple D is 13.20 $mm^2$; the area of the dimple E is 11.64 $mm^2$; and the area of the dimple F is 7.07 $mm^2$.

According to the present invention, a ratio of the sum of the total of area s of all the dimples 8 to the surface area of the phantom sphere 30 is referred to as an occupation ratio. From the standpoint that a sufficient dimple effect may be achieved, the occupation ratio is preferably equal to or greater than 75%, more preferably equal to or greater than 78%, and particularly preferably equal to or greater than 81%. The occupation ratio is preferably equal to or less than 90%. According to the golf ball 2 shown in FIG. 2 to FIG. 6, total area of the dimples 8 is 4675.2 $mm^2$. Because the surface area of the phantom sphere 30 of this golf ball 2 is 5728.0 $mm^2$, the occupation ratio is 81.6%.

According to the present invention, the term "dimple volume" means a volume of a part surrounded by a plane that includes the contour of the dimple 8, and the surface of the dimple 8. In light of a possible suppression of hopping of the golf ball 2, a total volume of the dimples 8 is preferably equal to or greater than 250 $mm^3$, more preferably equal to or greater than 260 $mm^3$, and particularly preferably equal to or greater than 270 $mm^3$. In light of a possible suppression of dropping of the golf ball 2, the total volume is preferably equal to or less than 400 $mm^3$, more preferably equal to or less than 390 $mm^3$, and particularly preferably equal to or less than 380 $mm^3$.

In light of a possible suppression of hopping of the golf ball 2, a depth of the dimple 8 is preferably equal to or greater than 0.05 mm, more preferably equal to or greater than 0.08 mm, and particularly preferably equal to or greater than 0.10 mm. In light of a possible suppression of dropping of the golf ball 2, the depth is preferably equal to or less than 0.60 mm, more preferably equal to or less than 0.45 mm, and particularly preferably equal to or less than 0.40 mm. The depth is a distance between the tangent line T and the deepest point of the dimple 8.

According to the present invention, a size of each site of the dimple 8 is measured on the golf ball 2 to which any paint is applied. Alternatively, the size may be measured on the golf ball 2 after removing the paint layer.

EXAMPLES

Example

A rubber composition was obtained by kneading 100 parts by weight of polybutadiene (trade name "BR-730", available from JSR Corporation), 30 parts by weight of zinc acrylate, 6 parts of zinc oxide, 10 parts by weight of barium sulfate, 0.5 part by weight of diphenyl disulfide and 0.5 part by weight of dicumyl peroxide. This rubber composition was placed into a mold having upper and lower mold half each having a hemispherical cavity, and heated at 170° C. for 18 minutes to obtain a core having a diameter of 39.7 mm. On the other hand, 50 parts by weight of an ionomer resin (available from Du Pont-MITSUI POLYCHEMICALS Co., Ltd.; trade name "Himilan 1605"), 50 parts by weight of other ionomer resin (available from Du Pont-MITSUI POLYCHEMICALS Co., Ltd.; trade name "Himilan 1706") and 3 parts by weight of titanium dioxide were kneaded to obtain a resin composition. The aforementioned core was placed into a final mold having numerous pimples on the inside face, followed by injection of the aforementioned resin composition around the spherical body by injection molding to form a cover having a thickness of 1.5 mm. Numerous dimples having a shape inverted from the shape of the pimples were formed on the cover. A clear paint including a two-part liquid curable polyurethane as a base was applied on this cover to give a golf ball of Example having a diameter of 42.7 mm and a weight of about 45.4 g. This golf ball had a PGA compression of about 85. This golf ball has a dimple pattern shown in FIG. 2 to FIG. 5. Details of the specifications of the dimples are presented in Table 1 below.

Comparative Example 1

Figure 7:
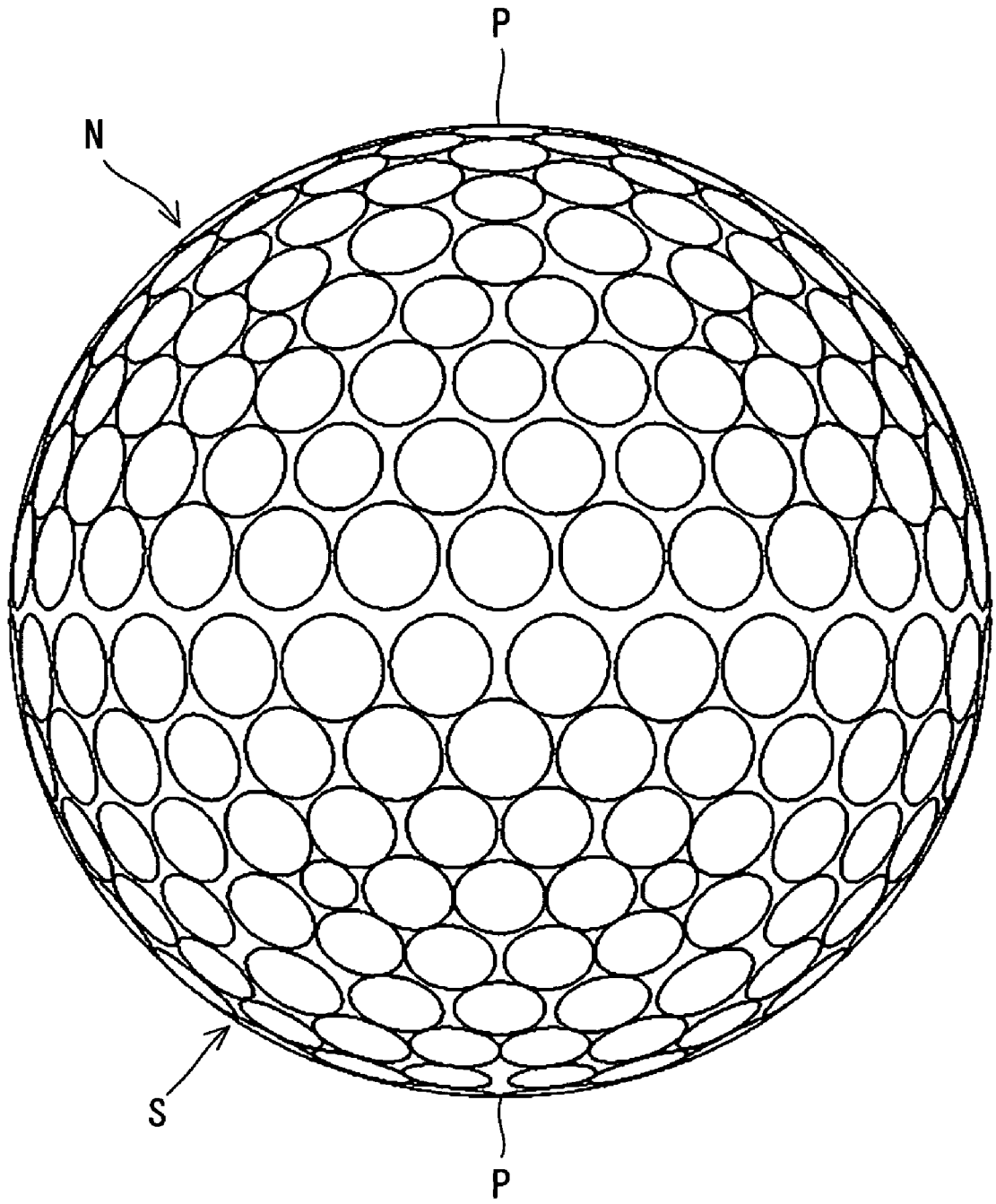
FIG. 7 shows a front view illustrating a golf ball according to Comparative Example 1.
Figure 8:
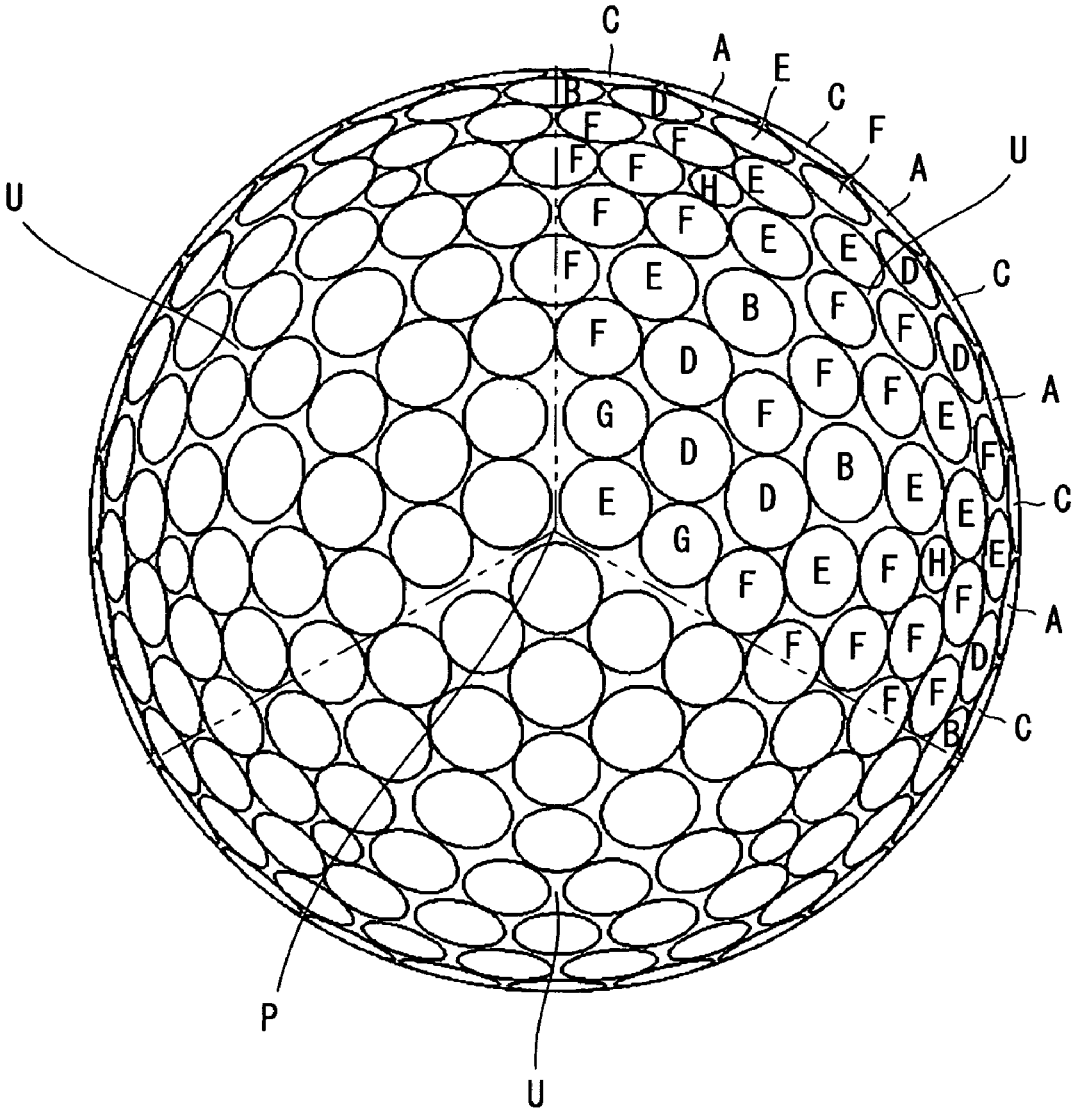
FIG. 8 shows a plan view illustrating the golf ball shown in FIG. 7.

A golf ball of Comparative Example 1 was obtained in a similar manner to the Example except that the dimples were formed by changing the final mold so that their specifications were as shown in Table 1 below. FIG. 7 shows a front view illustrating this golf ball, and FIG. 8 shows a plan view of the same. The northern hemisphere and the southern hemisphere of this golf ball have units U having rotational symmetries through 120°. In each of the northern hemisphere and the southern hemisphere, the number of the units U is 3. In FIG. 8, the types of the dimples are shown by the reference signs from A to H with respect to one unit.

Comparative Example 2

Figure 9:
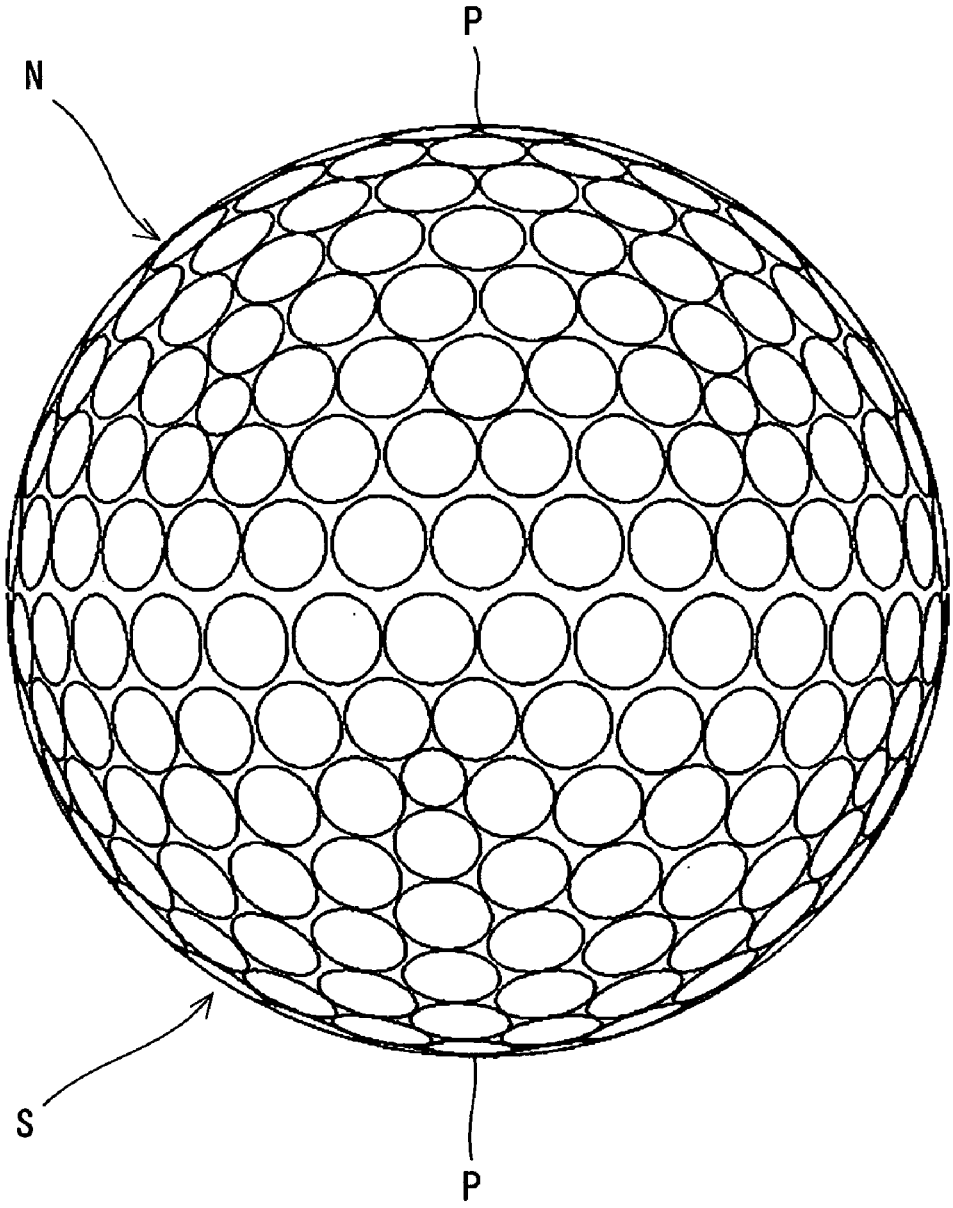
FIG. 9 shows a front view illustrating a golf ball according to Comparative Example 2.
Figure 10:
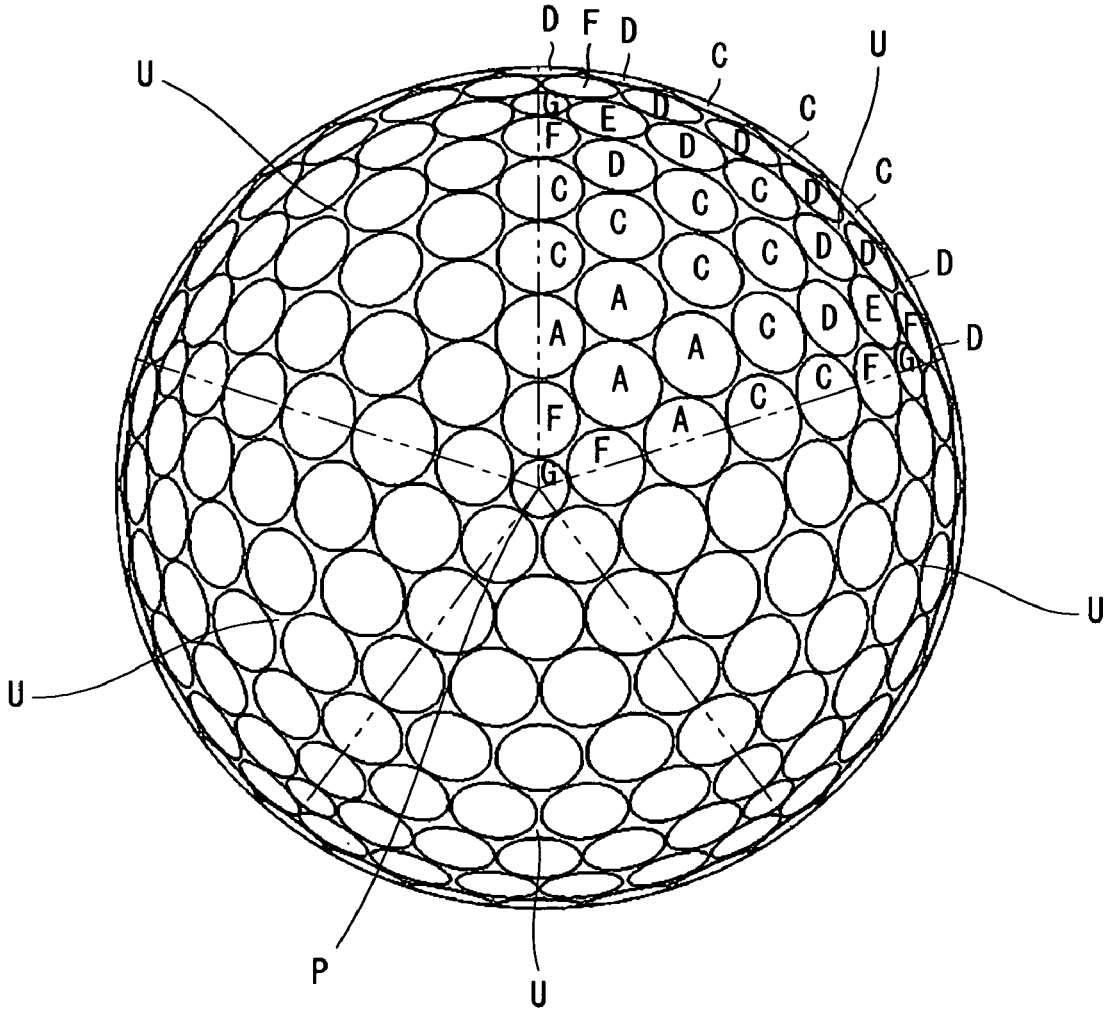
FIG. 10 shows a plan view illustrating the golf ball shown in FIG. 9.

A golf ball of Comparative Example 2 was obtained in a similar manner to Example except that the dimples were formed by changing the final mold so that their specifications were as shown in Table 1 below. FIG. 9 shows a front view illustrating this golf ball, and FIG. 10 shows a plan view of the same. The northern hemisphere and the southern hemisphere of this golf ball have units U having rotational symmetries through 72°. In each of the northern hemisphere and the southern hemisphere, the number of the units U is 5. In FIG. 10, the types of the dimples are shown by the reference signs from A to G with respect to one unit.

TABLE 1

| Specifications of Dimples | | | | | |
|---|---|---|---|---|---|
| Type | Number | Diameter (mm) | Depth (mm) | Curvature (mm) | Volume ($mm^3$) |
| Example | | | | | |
| A | 80 | 4.55 | 0.140 | 18.55 | 1.140 |
| B | 80 | 4.45 | 0.130 | 19.11 | 1.012 |
| C | 60 | 4.25 | 0.130 | 17.43 | 0.923 |
| D | 40 | 4.10 | 0.130 | 16.23 | 0.859 |
| E | 56 | 3.85 | 0.130 | 14.32 | 0.758 |
| F | 14 | 3.00 | 0.125 | 9.06 | 0.443 |
| Comparative Example 1 | | | | | |
| A | 24 | 4.75 | 0.140 | 20.22 | 1.242 |
| B | 18 | 4.65 | 0.140 | 19.38 | 1.190 |
| C | 30 | 4.55 | 0.135 | 19.24 | 1.051 |
| D | 42 | 4.45 | 0.135 | 18.40 | 1.051 |
| E | 66 | 4.25 | 0.135 | 16.79 | 0.959 |
| F | 126 | 4.05 | 0.130 | 15.84 | 0.839 |
| G | 12 | 3.95 | 0.130 | 15.07 | 0.798 |
| H | 12 | 2.80 | 0.120 | 8.23 | 0.370 |
| Comparative Example 2 | | | | | |
| A | 40 | 4.55 | 0.140 | 18.55 | 1.140 |
| B | 70 | 4.45 | 0.135 | 18.40 | 1.051 |
| C | 40 | 4.30 | 0.135 | 17.19 | 0.982 |
| D | 110 | 4.20 | 0.130 | 17.03 | 0.902 |
| E | 20 | 4.10 | 0.130 | 16.23 | 0.859 |
| F | 40 | 3.90 | 0.130 | 14.69 | 0.778 |
| G | 12 | 2.90 | 0.120 | 8.82 | 0.397 |

Travel Distance Test

A driver with a titanium head (trade name "XXIO", available from SRI Sports Ltd., shaft hardness: X, loft angle: 9°) was attached to a swing machine, available from True Temper Co. Then the golf ball was hit under the condition to provide a head speed of 49 m/sec, a launch angle being about 11° and give the initial spin rate of about 3000 rpm. Accordingly, the distance from the launching point to the point where the ball stopped was measured. Under the condition during the test, it was almost windless. Mean values of 20 times measurement are presented in Table 2 below.

TABLE 2

| Results of Evaluation | Example | Comparative Example 1 | Comparative Example 2 |
|---|---|---|---|
| Total number of dimples | 330 | 330 | 332 |
| Total volume ($mm^3$) | 311 | 311 | 311 |
| Occupation ratio (%) | 81.6 | 81.2 | 81.4 |
| Pole vicinity region | | | |
| Rotation symmetry angle (deg.) | 72 | — | — |
| Number of units Np | 5 | — | — |
| Coordination region | Line symmetry | — | — |
| Equator vicinity region | | | |
| Rotation symmetry angle (deg.) | 60 | — | — |
| Number of units Np | 6 | — | — |
| Northern and southern hemispheres | | | |
| Rotation symmetry angle (deg.) | — | 120 | 72 |
| Number of units | — | 3 | 5 |
| Travel distance (m) | 237.5 | 235.4 | 234.9 |

As shown in Table 2, the golf ball of the Example is excellent in the flight performance. Therefore, the advantages of the present invention are clearly suggested by these results of evaluation.

The dimple pattern according to the present invention can be applied to not only two-piece golf balls, but also one-piece golf balls, multi-piece golf balls and wound golf balls. The foregoing description is just for illustrative examples, and various modifications can be made in the scope without departing from the principles of the present invention.

What is claimed is:

1. A golf ball wherein each of the northern hemisphere and the southern hemisphere thereof has a surface comprising a pole vicinity region, an equator vicinity region, and a coordination region located between the pole vicinity region and the equator vicinity region, each of the pole vicinity region, the equator vicinity region and the coordination region having numerous dimples, the dimple pattern in the pole vicinity region including multiple units that are rotationally symmetric to each other centered on the pole point, the dimple pattern in the equator vicinity region including multiple units that are rotationally symmetric to each other centered on the pole point, a number of the units in the pole vicinity region being different from a number of the units in the equator vicinity region, the dimple pattern in the coordination region being either a pattern which cannot be comparted into multiple units that are rotationally symmetric to each other centered on the pole point, or a pattern including multiple units that are rotationally symmetric to each other centered on the pole point with a number of the units being different from the numbers of the units of the pole vicinity region and the equator vicinity region.

2. The golf ball according to claim 1, wherein a boundary line between the pole vicinity region and the coordination region is a latitude line, the latitude of which is 20° or greater and 40° or less, and a boundary line between the coordination region and the equator vicinity region is a latitude line the latitude of which is 20° or greater and 40° or less.

3. The golf ball according to claim 1, wherein the number of the units in the pole vicinity region is equal to or greater than 4, and the number of the units in the equator vicinity region is equal to or greater than 4.

4. The golf ball according to claim 3, wherein the number of the units in the pole vicinity region is equal to or greater than 5, and the number of the units in the equator vicinity region is equal to or greater than 5.

5. The golf ball according to claim 1, wherein a total number of the dimples is equal to or less than 360, and a proportion of a total area of all dimples to a surface area of the phantom sphere is equal to or greater than 75%.

6. The golf ball according to claim 1, wherein the number of the units in the pole vicinity region is an odd number, and the number of the units in the equator vicinity region is an even number.

7. The golf ball according to claim 6, wherein the difference between the number of the units in the pole vicinity region and the number of the units in the equator vicinity region is 1.

8. The golf ball according to claim 1, wherein the number of the units in the pole vicinity region is an even number, and the number of the units in the equator vicinity region is an odd number.

9. The golf ball according to claim 8, wherein the difference between the number of the units in the pole vicinity region and the number of the units in the equator vicinity region is 1.

* * * * *